United States Patent [19]

Lundberg et al.

[11] Patent Number: 4,460,170

[45] Date of Patent: Jul. 17, 1984

[54] VAULTING BOARDS

[75] Inventors: Duane R. Lundberg, Jefferson, Iowa; Joseph S. Thomas, Jr., Croton on Hudson, N.Y.

[73] Assignee: AMF Inc., White Plains, N.Y.

[21] Appl. No.: 383,059

[22] Filed: May 28, 1982

[51] Int. Cl.[3] ..... A63B 5/08

[52] U.S. Cl. ..... 272/65; 267/158

[58] Field of Search ..... 272/65, 66, 70, 69; 267/160, 158, 44, 47, 52

[56] References Cited

U.S. PATENT DOCUMENTS

| | | | |
|---|---|---|---|
| 2,025,263 | 12/1935 | Arner | 267/44 |
| 2,112,315 | 3/1938 | Townsend | 272/66 |
| 3,079,139 | 2/1963 | Greene et al. | 267/47 |
| 3,490,758 | 1/1970 | Foster | 267/158 |
| 3,968,964 | 7/1976 | Grosser et al. | 272/65 |

*Primary Examiner*—Richard J. Apley
*Assistant Examiner*—S. R. Crow
*Attorney, Agent, or Firm*—David E. Dougherty; Walter R. Pfluger, Jr.

[57] ABSTRACT

A vaulting board is fastened at one end to a frame and slopes up under the action of two spaced apart, concave upwards, leaf springs carrying rollers on each end which contact the under side of the board. The spring centers are clamped in assemblies carrying transverse shafts at the bottom and the curved ends of J-bolts fit around the shafts and are connected to the frame, so that the springs pivot about the shafts axes under vaulting impact to equalize the stresses impressed in the board by the spring ends.

6 Claims, 5 Drawing Figures

VAULTING BOARDS

This invention relates to a vaulting board, and more particularly, to an improvement in vaulting boards having leaf springs.

The invention is useful in vaulting boards such as shown in Grosser and Long U.S. Pat. No. 3,968,964 (1976) which is assigned to the same assignee as the instant invention. These devices typically comprise a bottom frame, an overlying spring board, and leaf springs between the two. In the past the centers of the leaf springs have been rigidly connected to a cross member of the frame. By virtue of the rigid mounting for the centers of the leaf springs unequal stresses have been imposed on opposite sides of the springs causing delamination in composite leaf springs.

It is an object of this invention to overcome the above mentioned problem and to provide other advantages.

Briefly, in the invention the centers of the leaf springs are pivotally mounted to the frame. This has equalized the stresses on opposite sides of the springs and reduced spring failures or delamination in composite springs.

The invention will be best understood by considering the ensuing description of several embodiments thereof when taken in connection with the accompanying drawings, in which.

Figure 1:
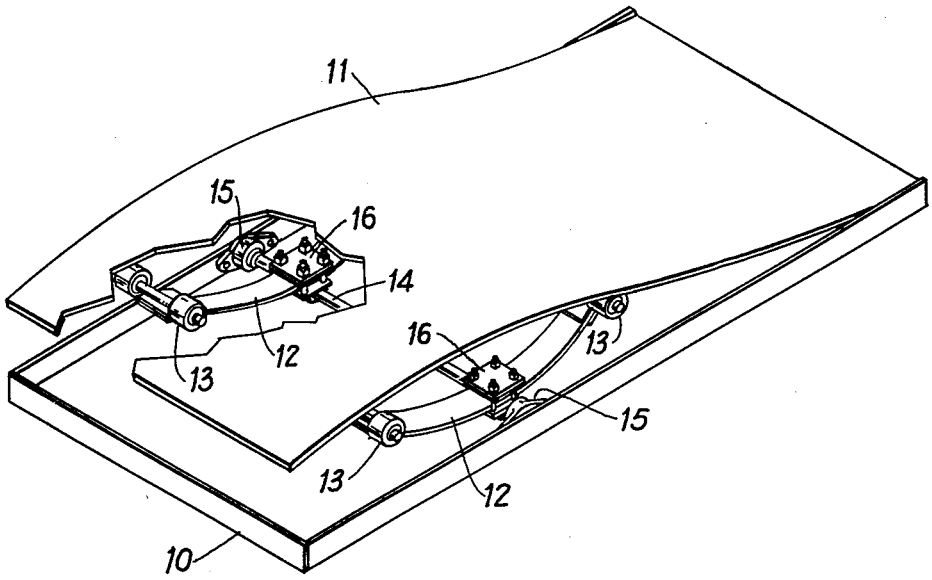
FIG. 1 is a broken away perspective view of a vaulting board incorporating one embodiment of the invention.

Turning now first to FIG. 1, shown therein is a vaulting board device of the type shown in the referred to prior U.S. Pat. No. 3,968,964. The device comprises a generally rectangular shaped base frame 10, an overlying spring board 11, and a pair of leaf springs 12 therebetween. At the right hand end of the device the spring board or platform 11 is connected to the frame 10, and then slopes upwardly therefrom so that the remainder of the board 11 is spaced from the frame 10.

The springs 12 are bowed upwardly or have a concave shape. At their outer ends they are provided with rollers 13 which are adapted to engage the underside of the spring board 11, for the purpose explained in said U.S. Pat. No. 3,968,964. In FIG. 1 the centers of the springs 12 are shown as being mounted on a shaft 14. Opposite ends of the shaft 14 are rotatably mounted in bearings 15 at opposite sides of the frame 10. Thus, the central portions of the leaf springs 12 are pivotally connected to or mounted with respect to the frame 10.

Figure 2:
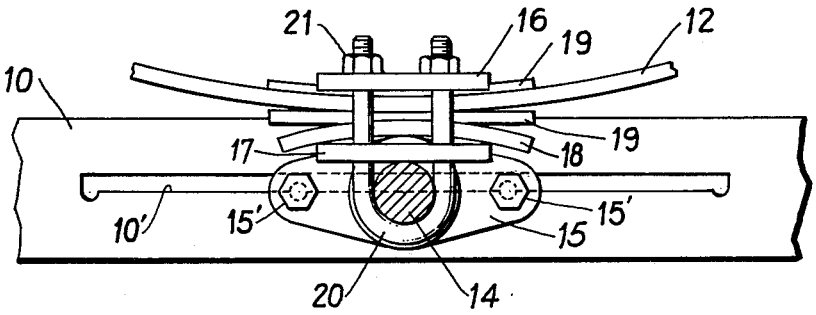
FIG. 2 is an enlarged broken away side view of the central spring mounting of FIG. 1.

The details of the connection of the centers of the springs to the frame will now be described by also referring to FIG. 2. As shown, top and bottom plates 16 and 17 traverse the centers of the leafs and overhang the same. An arcuate or convex shaped plate 18 overlies the bottom plate 17 and rubber pads 19 are positioned along opposite sides of the leafs 12. U-bolts 20 extend through the overhangs of the top and bottom plates 16 and 17, and the shaft 14 extends through the U-bolts 20 between the closed end thereof and the bottom plate 17. When nuts 21 on the threaded free ends of the bolts 20 are tightened the parts 12, 16, 17, 18, 19 are clamped together and simultaneously this sub-assembly of parts 12, 16–19 is clamped to the shaft 14. Since the shaft 14 is rotatable in the bearing assemblies 15 the central portions of the leaf springs in effect are pivotally mounted to the opposite sides of the frame 10.

Thus, the centers of the springs 12 can swing, pivot, or rotate with respect to the frame 10. When a user leaps on the board 11 tremendous forces are imposed on the springs. The ability of the centers of the springs to move tends to equalize the stresses imposed on opposite ends of the springs. This has prolonged spring life by reducing their failure and delamination.

Another advantage of the improved spring center mounting is that it is possible to make an adjustment therein to make the board 11 softer or stiffer by moving the pivot assembly 14–21 forward or backward along the sides of the frame 10 to adjust its position at the center of the springs. This can be achieved by simply loosening two bolts 15' in a slot 10' on each side of the frame and sliding the pivot assembly to desired position.

Figure 3:
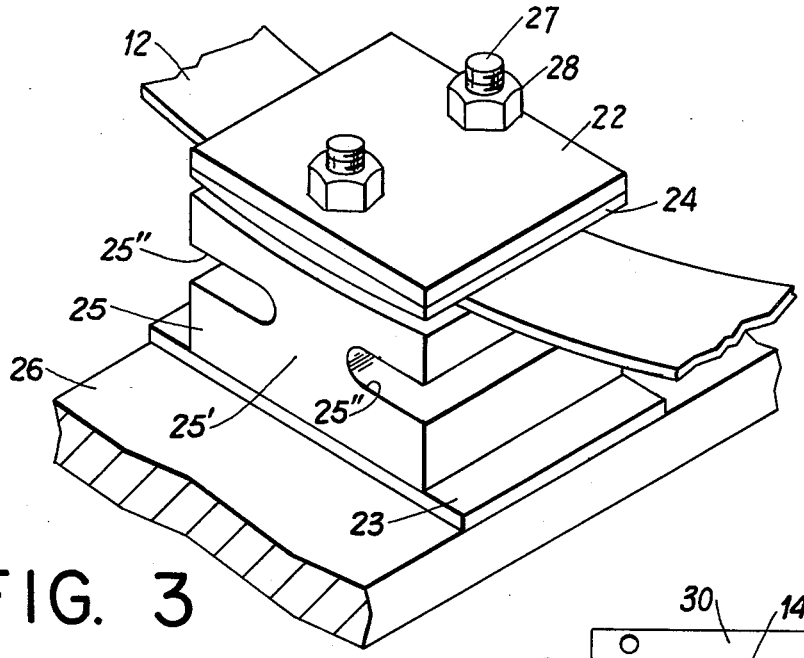
FIG. 3 is a broken away perspective view of a second embodiment of the invention wherein a block of rubber is used to provide a pivotal mounting for the spring centers.

Turning now to FIG. 3, shown therein is an embodiment wherein the leaf centers are able to move by virtue of being mounted to blocks of resilient material such as rubber. As shown, there is a top plate 22, and a bottom plate 23. A rubber pad 24 is positioned between the top plate 22 and the leaf spring 12 and a thick I-shaped rubber block 25 between the leaf 12 and bottom plate 23. A frame cross member 26 is provided on the frame 10. The subassembly of parts 12, 22, 23, 24, 25 is clamped together and mounted to the cross member 26 by bolts 27 extending through the parts 22–26. When nuts 28 are tightened the leaf 12 is clamped between the parts 22–25 and mounted to the sides of the frame 10. The bolts extend through the parts 22–26 but not through the leaf 12.

The bolts 27 do not pass through the leafs. Therefore, to adjust their pivots along the leafs all that needs to be done is to move the bolts 27 to a different position on the cross member 26. A series of not shown apertures can be provided on member 26 for this purpose, or a slot can be utilized as in FIG. 2.

The block of rubber 25 has a thick, squat or flat I-shape. The stem 25' of the I-shape is defined by the notches 25'' on opposite sides of the block 25 which extend in a direction traverse of the leaf. The rather thick stem 25' of the block, since it is resilient, operates as the point about which the leaf 12 can swing, rock, or pivot with respect to its mounting 26 on the frame 10. In other words, the block 25 operates similar to the rotary mounting 14 in FIGS. 1 and 2 and provides similar advantages in terms of stress equalization on opposite sides of the leaf.

The second form of the invention is a resilient compliant pivot for the centers of the leafs. When properly designed and installed it will give the same advantages as the first form of the invention and in addition reduce the number of necessary parts, and the costs too, although the rubber block 25 must be a high quality element.

Figure 5:
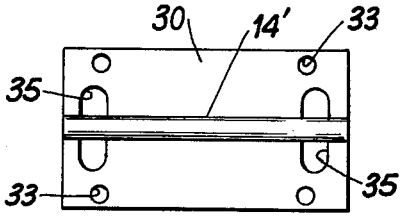
FIG. 5 is a bottom plan view of the bottom clamp plate of FIG. 4.
Figure 4:
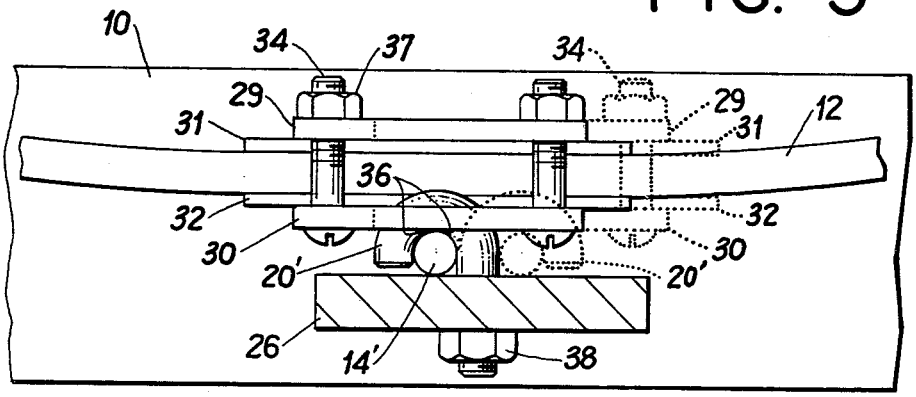
FIG. 4 is a broken away perspective view of a third embodiment of the invention.

The third form of the invention will now be described by referring to FIGS. 4 and 5. This form of the invention uses a frame cross mounting member 26 on the base frame 10, similar to the second form of the invention. It also has a rotary type of mounting similar to the first form of the invention. However, as contrasted thereto it does not use a long shaft 14, U-bolts 20, and bearings 15 but less expensive parts such as short pivot shafts 14' and J-bolts 20'.

The leaf 12 is provided with top and bottom plates 29 and 30 and top and bottom rubber pads 31 and 32. The top and bottom plates 29 and 30 are similar in external shape, and their ends overhang the side edges of the leaf 12. They have four corner holes 33 for the bolts 34, see FIG. 5. In addition however, the bottom plate 30 has two end notches 35 for the upper curved ends of the J-bolts 20' and also a short pivot shaft 14' along the bottom thereof. The notches 35 extend lengthwise of the leaf, whereas the short shaft 14' extends transverse to the leaf. The shaft 14' is only as long as the plate 30 and is connected to the underside thereof by suitable means such as a weld 36.

When the nuts 37 on the bolts 34 are tightened the leaf 12 is clamped between the parts 29–32. The bolts 34 do not pass through the leaf 12 but only through the ends of the plates 29, 30 which overhang the side edges of the leaf. The bolts 34 may or may not pass through the rubber pads 31, 32.

The J-shaped bolts 20' are placed in their illustrated position before assembling the parts 12, 29–32 together by dropping them in the notches 35 so that curved ends are hooked on the short shaft 14'. After the parts 12, 29–32 are clamped together by the bolts 34 and their nuts 37 the stem of the J-bolt 20' is inserted into a hole formed in the frame cross mounting member 26. When the nuts 38 on the J-bolts 20' are tightened the shaft 14' is rotatably mounted on frame cross member 26 since it is trapped thereon within the curved end of the J-bolt 20'. Since the plate 30 is connected to shaft 14' by the welds 36, the centers of the spring 12 will pivot, swing, rock or turn with the pivot shafts 14'.

As in the prior forms of the invention the pivots of the leafs can be adjusted slightly to the left or right. If the J-bolts 20' are shifted 180° when they are then assembled to the frame cross member 26 the leaf pivots are shifted to the right to give the spring board a different feel. This mode of adjustment is shown in FIG. 4 in dotted outline.

In all forms of the invention means is provided to adjust the position of the pivots, but without changing the position of the springs, simply by shifting the pivots lengthwise with respect to the leafs and frame. The invention has the further advantage that it can be readily added to existing vaulting board devices in the field.

We claim:

1. In a vaulting board device with a base frame and an overlying spring board connected at one board end to a frame end in which the board slopes up from the connection to be spaced from the frame, the improvement conprising a pair of bowed leaf springs positioned between the frame and the board along opposite sides thereof, the spring centers being connected to opposite sides of the frame by a pivotal mounting which comprises clamp means connected to the centers of said springs, short pivot shafts affixed to said clamp means, and means pivotally connecting said short pivot shafts to opposite sides of said frame.

2. In a vaulting board device as in claim 1, wherein said last mentioned means comprises a cross mounting member spanning opposite sides of said frame, and J-shaped bolts connected to said cross mounting member and hooked on to said short pivot shafts.

3. In a vaulting board device as in claim 2, said clamp means comprising top and bottom plates and intervening rubber pads clamped by bolts to opposite sides of said spring centers, said top and bottom plates having opposite edges which overhang opposite side edges of said springs, said bolts extending through said top and bottom plates at said opposite overhanging edges, said short pivot shafts being affixed to said bottom plates.

4. In a vaulting board device as in claim 3, slots in the opposite overhanging sides edges of said bottom plates, said short pivot shafts being weld connected to the underside of the bottom plates, and the curved ends of said J-bolts being disposed in said slots to embrace said short pivot shafts and trap the same therein against said cross mounting member.

5. In a vaulting board device comprising a base frame, an overlying spaced spring board, and bowed leaf springs between said board and frame, means pivotally mounting the centers of said springs to said frame comprising a cross mounting member on said frame, J-shaped bolts connected to said cross mounting member, clamp means connected to the centers of said springs, short pivot shafts connected to said clamp means, and the curved ends of said J-bolts being hooked on to the opposite ends of said shafts to pivotally connect said spring centers to said cross mounting member.

6. In a vaulting board device comprising a base frame means, an overlying spring board spaced therefrom and bowed leaf springs therebetween, clamp means comprising top and bottom clamp plates and intervening resilient pads clamped to the centers of said springs, shaft means connected to the bottom clamp plates and curved bolts connecting said base frame means to said shaft means whereby said spring centers have pivotal movement with respect to said base frame means.

* * * * *

UNITED STATES PATENT AND TRADEMARK OFFICE

CERTIFICATE OF CORRECTION

PATENT NO. : 4,460,170

DATED : July 17, 1984

INVENTOR(S) : Duane R. Lundberg et al.

It is certified that error appears in the above-identified patent and that said Letters Patent is hereby corrected as shown below:

Column 4, line 3, "conprising" should read -- comprising --.

Signed and Sealed this

First Day of January 1985

[SEAL]

*Attest:*

GERALD J. MOSSINGHOFF

*Attesting Officer*

*Commissioner of Patents and Trademarks*